US009559430B2

(12) United States Patent
Howard et al.

(10) Patent No.: US 9,559,430 B2
(45) Date of Patent: Jan. 31, 2017

(54) ULTRA-BROADBAND ANTENNA ARRAY WITH CONSTANT BEAMWIDTH THROUGHOUT OPERATING FREQUENCY BAND

(71) Applicant: John Howard, Upper Mount Bethel, PA (US)

(72) Inventors: John Howard, Upper Mount Bethel, PA (US); Chuck Wah Fung, Mountain Lakes, NJ (US)

(73) Assignee: John Howard, Upper Mount Bethel, PA (US)

( * ) Notice: Subject to any disclaimer, the term of this patent is extended or adjusted under 35 U.S.C. 154(b) by 114 days.

(21) Appl. No.: 14/474,414

(22) Filed: Sep. 2, 2014

(65) Prior Publication Data

US 2015/0061955 A1 Mar. 5, 2015

Related U.S. Application Data

(60) Provisional application No. 61/874,035, filed on Sep. 5, 2013.

(51) Int. Cl.
*H01Q 21/06* (2006.01)
*H01Q 21/30* (2006.01)
(Continued)

(52) U.S. Cl.
CPC ..... *H01Q 21/06* (2013.01); *H01Q 13/085* (2013.01); *H01Q 21/0087* (2013.01);
(Continued)

(58) Field of Classification Search
CPC ..... H01Q 21/06; H01Q 21/30
(Continued)

(56) References Cited

U.S. PATENT DOCUMENTS 2,562,332 A 7/1951 Riblet
7,271,775 B1 9/2007 Rossman et al.
(Continued)

FOREIGN PATENT DOCUMENTS

DE 102005003685 A1 8/2006
GB 2431050 A 11/2007
(Continued)

OTHER PUBLICATIONS

European Search Report, EP 14 18 3701, Jan. 28, 2015.

*Primary Examiner* — Dameon E Levi
*Assistant Examiner* — Andrea Lindgren Baltzell
(74) *Attorney, Agent, or Firm* — Hoffmann & Baron, LLP

(57) ABSTRACT

An antenna array includes a plurality of antenna elements configured in a flare such that each of the plurality of antenna elements is uniformly spaced apart from at least one adjacent antenna element. Each of the plurality of antenna elements is coupled in a common area, and each of the plurality of antenna elements extends radially outward from the common area. A method of arranging antenna elements in an antenna array includes configuring a plurality of antenna elements in a flare such that each antenna element is uniformly spaced apart from at least one adjacent antenna element, and each of the plurality of antenna elements extends radially outward from a common area; and coupling each of the plurality of antenna elements in the common area.

10 Claims, 6 Drawing Sheets

(51) Int. Cl.

| | |
|---|---|
| ***H01Q 21/20*** | (2006.01) |
| ***H01Q 21/00*** | (2006.01) |
| ***H01Q 13/08*** | (2006.01) |
| *H01Q 9/28* | (2006.01) |
| *H01Q 11/10* | (2006.01) |

(52) U.S. Cl.
CPC ..... *H01Q 21/205* (2013.01); *H01Q 21/30* (2013.01); *H01Q 9/28* (2013.01); *H01Q 11/10* (2013.01); *Y10T 29/49016* (2015.01)

(58) Field of Classification Search
USPC ..... 343/770
See application file for complete search history.

(56) References Cited

U.S. PATENT DOCUMENTS

| | | | | |
|---|---|---|---|---|
| 7,518,565 | B1 * | 4/2009 | Horner ..... | H01Q 13/10 342/375 |
| 2003/0052828 | A1 * | 3/2003 | Scherzer et al. ..... | H01Q 21/30 343/795 |

FOREIGN PATENT DOCUMENTS

| | | | |
|---|---|---|---|
| WO | 2008/065311 | A2 | 6/2008 |
| WO | 2011/109238 | A1 | 9/2011 |

* cited by examiner

ULTRA-BROADBAND ANTENNA ARRAY WITH CONSTANT BEAMWIDTH THROUGHOUT OPERATING FREQUENCY BAND

CROSS-REFERENCE TO RELATED APPLICATION

This application claims the benefit of U.S. Provisional Application No. 61/874,035, filed Sep. 5, 2013, the disclosure of which is incorporated herein by reference in its entirety.

BACKGROUND

Field

Embodiments disclosed herein generally relate to antennas and, more particularly, relate to circular, spherical, conformal ultra-broadband antenna arrays having a substantially constant beamwidth throughout a band of operation.

SUMMARY

In accordance with one embodiment, an antenna array is provided, which includes a plurality of antenna elements configured in a flare such that each of the plurality of antenna elements is uniformly spaced apart from at least one adjacent antenna element. Each of the plurality of antenna elements is coupled in a common area, and each of the plurality of antenna elements extends radially outward from the common area.

The plurality of antenna elements may be configured in at least one of a circle, half circle, sphere, and plane. At least one of the plurality of antenna elements may include at least one of a bow tie antenna, log-periodic antenna, and Vivaldi antenna. The antenna array may include an axis of symmetry extending through the common area, and at least one of the plurality of antenna elements may include a planar area, which includes an edge that is disposed non-parallel to the axis of symmetry when viewed normal to the axis of symmetry. The antenna array may include an axis of symmetry, and at least one of the plurality of antenna elements may be disposed at a tilt with respect to the axis of symmetry. The feed may be disposed in the common area and operatively coupled to at least one of the plurality of antenna elements.

In accordance with another embodiment, a method of arranging antenna elements in an antenna array includes configuring a plurality of antenna elements in a flare such that each antenna element is uniformly spaced apart from at least one adjacent antenna element, and each of the plurality of antenna elements extends radially outward from a common area; and coupling each of the plurality of antenna elements in the common area.

The method may include configuring the plurality of antenna elements in at least one of a circle, half circle, sphere, and plane. At least one of the plurality of antenna elements may include at least one of a bow tie antenna, log-periodic antenna, and Vivaldi antenna. The antenna array may include an axis of symmetry extending through the common area, and at least one of the plurality of antenna elements may include a planar area. The planar area may include an edge, and the method may include disposing the edge non-parallel to the axis of symmetry when viewed normal to the axis of symmetry. The antenna array may include an axis of symmetry, and the method may include disposing at least one of the plurality of antenna elements at a tilt with respect to the axis of symmetry. The antenna array may include a feed, and the method may include disposing the feed in the common area, and operatively coupling the feed to at least one of the plurality of antenna elements.

Other embodiments will become apparent from the following detailed description considered in conjunction with the accompanying drawings. It is to be understood, however, that the drawings are designed as an illustration only and not as a definition of the limits of any disclosed embodiments.

BRIEF DESCRIPTION OF THE DRAWINGS

The following drawings are provided by way of example only and without limitation, wherein like reference numerals (when used) indicate corresponding elements throughout the several views, and wherein.

It is to be appreciated that elements in the figures are illustrated for simplicity and clarity. Common but well-understood elements that are useful or necessary in a commercially feasible embodiment are not shown in order to facilitate a less hindered view of the illustrated embodiments.

DETAILED DESCRIPTION

A circular antenna array is an antenna, which includes antenna elements arranged in a circle. A conformal antenna array is an antenna that is designed to conform or follow a predetermined shape. In accordance with embodiments disclosed herein, elements on the circular and/or conformal array are spaced at a certain distance in relation to an operating wavelength $\lambda$ or operating band of wavelengths. This spacing remains constant from element to element at all frequencies of operation.

Figure 1:
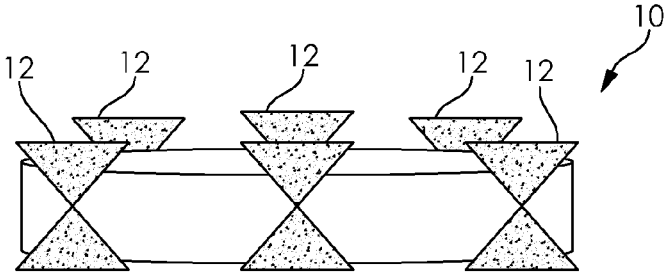
FIG. 1 shows a circular array of antenna elements.

FIG. 1 shows a circular antenna array 10 with bow tie antenna elements 12 arranged in a vertical polarization. Although bow tie antenna elements 12 are shown in the circular antenna array 10, any type of antenna element may be used in the illustrated configuration. Embodiments disclosed herein include ultra-broadband antenna arrays, in connection with which large frequency bands are used that can result in large fluctuations in beamwidth.

A wavelength $\lambda$ of the operating signal is given by the following equation:

$$\lambda = \frac{V}{f}, \tag{1}$$

where V represents the phase speed or magnitude of the phase velocity of light ($3\times10^8$ meters/second), and f represents the wave frequency. Equation (1) provides a basis for explaining a flare in the embodiments disclosed herein. For every frequency f, there is a different wavelength λ since the phase velocity V is a constant. Thus, as the wavelength λ changes, so too must the frequency f change. The spacing of antenna elements in the flare in relation to the wavelength λ is maintained to provide a constant beamwidth. Thus, the flare is used to maintain the correct proportion of frequency f with respect to the wavelength λ.

Since ultra-broadband operation includes a wide band of frequencies, the corresponding frequency f changes substantially, which causes the wavelength λ to change significantly as the frequency f changes. Because broadband antenna arrays in accordance with embodiments disclosed herein operate over such a wide range of frequencies, the antenna elements in the broadband antenna array are flared to maintain adequate spacing in relation to the wavelength λ throughout the frequency range of operation. Since the minimum and maximum operating frequencies of the broadband antenna array are known, the distance between each element at the minimum and maximum operating frequency can be calculated using equation (1). For example, assuming an antenna that operates from 300 MHz to 3 GHz, the wavelengths are as follows:

wavelength λ at 300 MHZ$=3\times10^8/300\times10^6\sim1$ meter;
and wavelength λ at 3 GHZ$=3\times10^8/3\times10^9\sim0.1$ meter.

Figure 6:
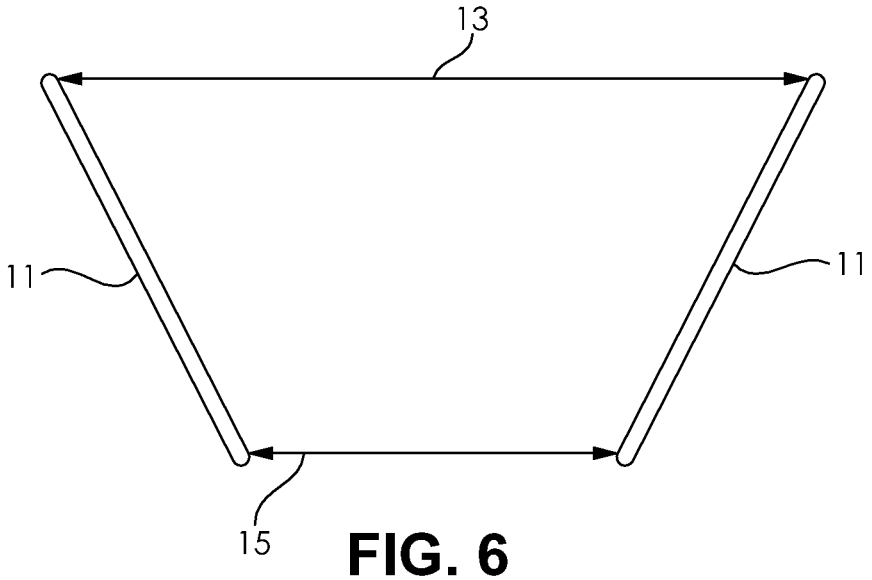
FIG. 6 shows a flare of antenna elements.

Thus, the flare between antenna elements for this example is as shown in FIG. 6, in which antenna elements 11 are separated at one end by dimension 13, which is approximately 1 meter, and separated at another end by dimension 15, which is approximately 0.1 meter. The view of the antenna elements 11 shown in FIG. 6 is essentially a top view, which is similar to the view of the antenna elements 16 shown in FIG. 2D and the view of the antenna elements 26, 28 shown in FIG. 4C.

Figure 2A:
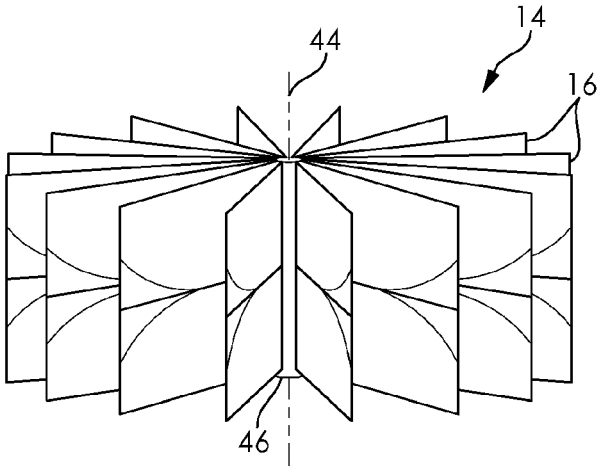
FIGS. 2A and 2B show isometric views of a flare of a circular and conformal array of antenna elements.
Figure 2B:
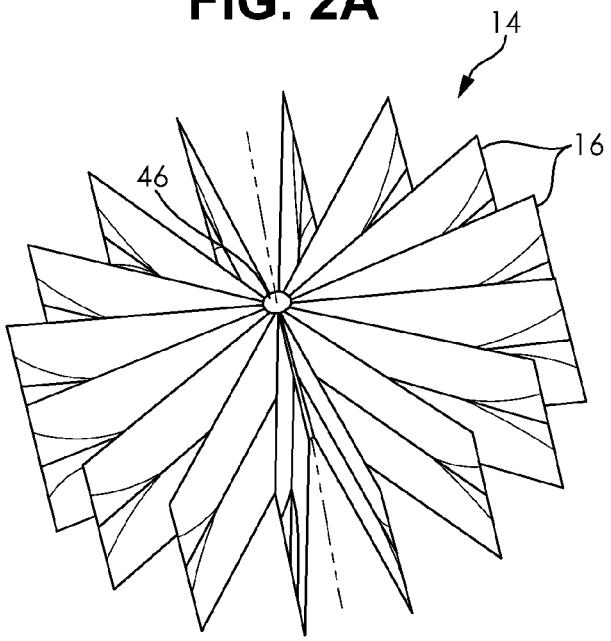
Figure 2C:
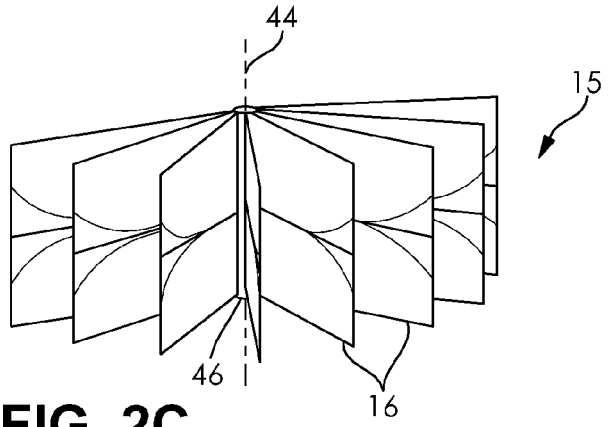
FIGS. 2C and 2D show isometric and top views, respectively, of a flare of a half circular and conformal array of antenna elements.
Figure 2D:
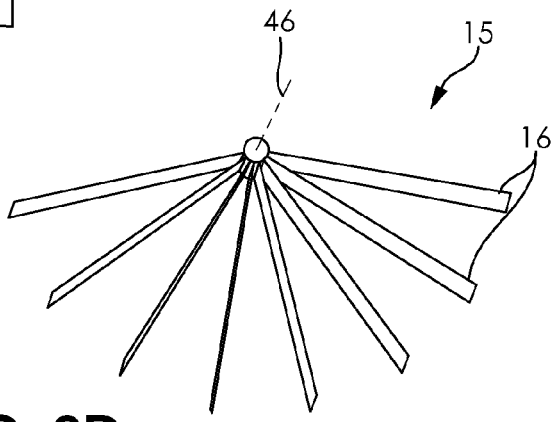
Figure 7A:
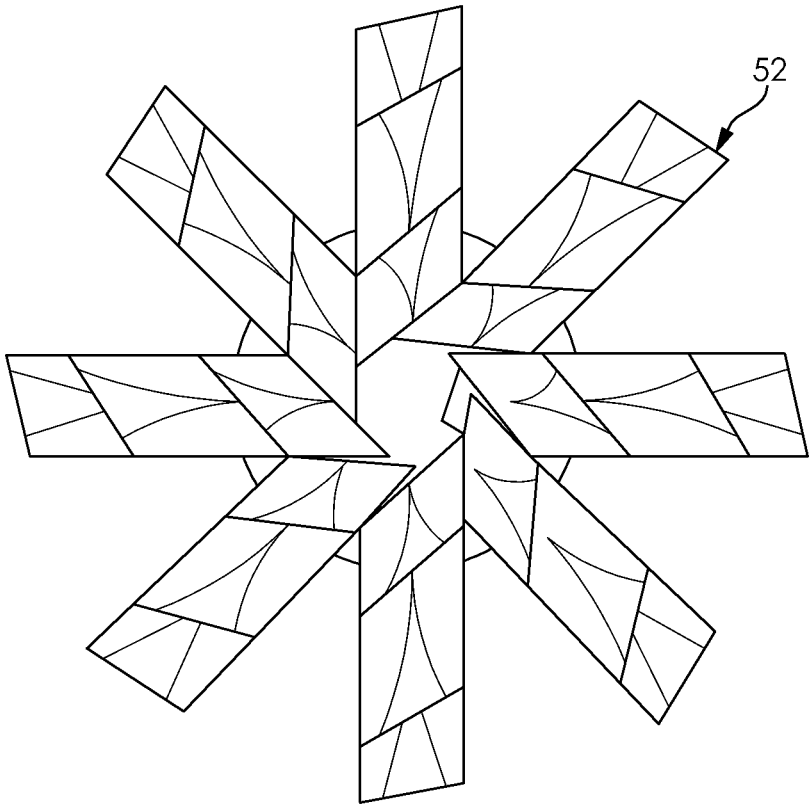
FIGS. 7A and 7B show a flare of antenna elements arranged in a semi-sphere.
Figure 7B:
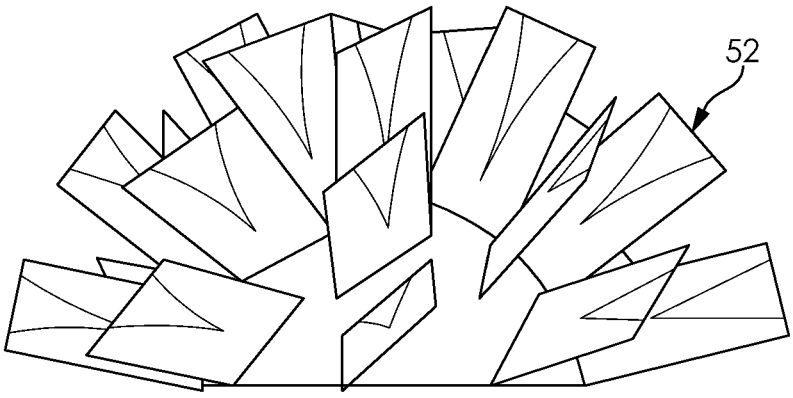
Figure 8A:
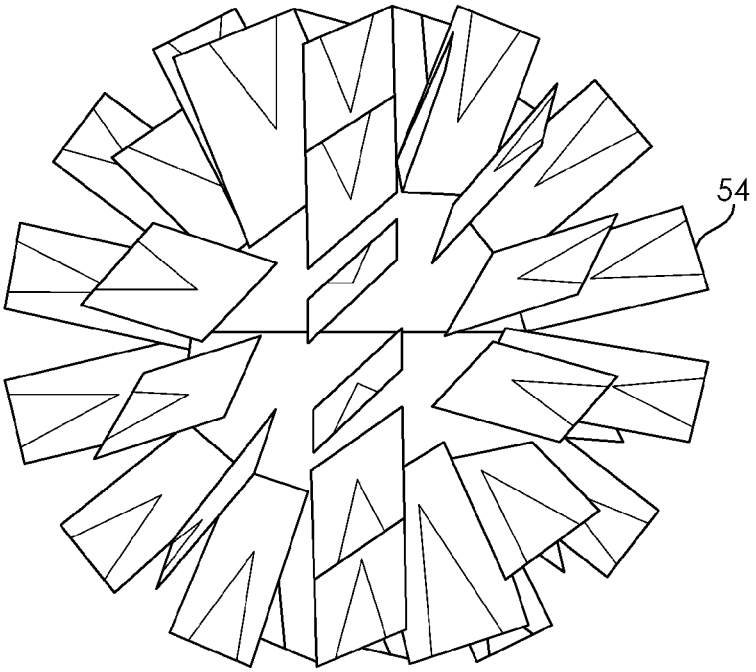
FIGS. 8A and 8B show a flare of antenna elements arranged in a sphere.
Figure 8B:
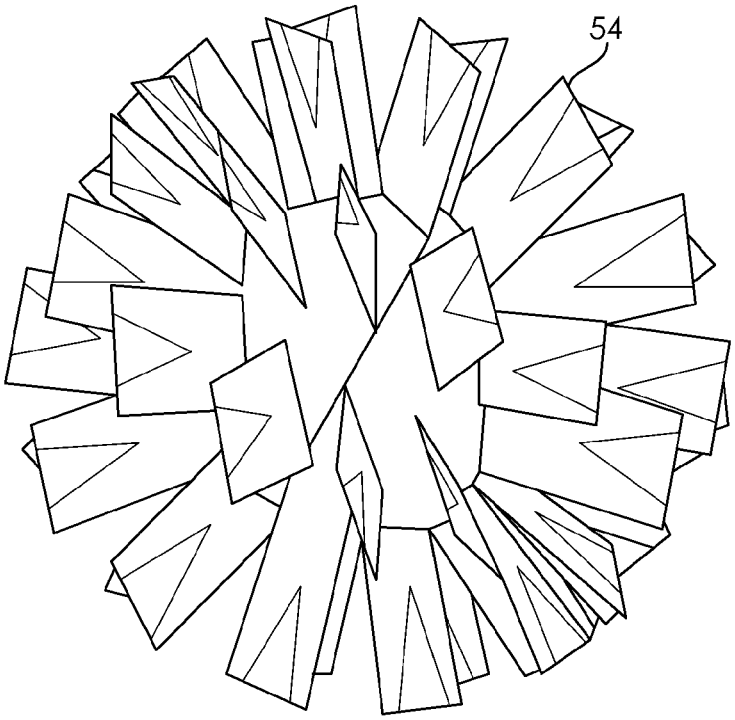

To provide adequate distance between antenna elements, flares 14, 15 of antenna elements 16 are used as shown in FIGS. 2A-D. These flares 14, 15 maintain inter-element distance between the antenna elements 16 with respect to the wavelength λ of the operating signal, which results in a constant beamwidth over the operating frequency range. FIGS. 2A and 2B show a flare 14 of antenna elements configured as a circular and conformal antenna array. FIGS. 2C and 2D show a flare 15 of antenna elements configured as a half circular and conformal antenna array. The antenna elements 16 are configured in the flare 14, 15 such that each of the plurality of antenna elements 16 is uniformly spaced apart from at least one adjacent antenna element 16, each of the plurality of antenna elements 16 is coupled in a common area 46, and each of the plurality of antenna elements extends radially outward from a common area 46. As discussed above, the antenna elements in the flare are spaced apart from each other based on the high and low frequencies in the operational frequency bandwidth. The quantity of antenna elements can be increased or decreased to form a circle, which can be result in a semi-sphere 52 shown in FIGS. 7A and 7B, a sphere 54, as shown in FIGS. 8A and 8B, and/or a conformal shape to provide azimuth and/or elevation coverage up to 360 degrees.

The disclosed embodiments utilize one or more broadband antenna elements. The flare, as used herein, refers to an antenna array in which the antenna elements are configured such that each antenna element is uniformly spaced apart from at least one adjacent antenna element, and each antenna element extends radially outward from a common central area. The antenna elements can be separately fed, which results in lower gain than when using a beam forming network. The beam forming network can be used to provide 360 degree coverage. Multiple beams can be generated using the beam forming network at, for example 0, 45, 90, 135, 180 degrees, each of which has substantially the same beamwidth due to the flare.

The antenna elements are fed from the common central area, from which the antenna elements radiate outward. However, log periodic antennas are fed in the opposite direction since the antenna elements radiate in the opposite direction, that is, towards the common central area. However, if the antenna elements are flared at 45 degrees, an opposing antenna element will be at −45 degrees, and since the antenna elements are spaced 90 degrees apart, the antenna elements will be orthogonal, and thus will not be blocked by radiation from opposing elements in such a configuration.

Figure 3A:
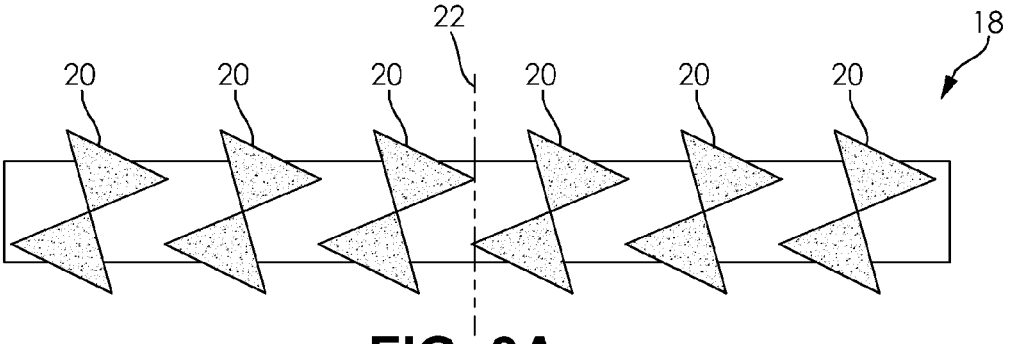
FIGS. 3A and 3B show side views of cross-polarized antenna elements at a 45 degree tilt in a planar antenna array and a circular antenna array, respectively.
Figure 3B:
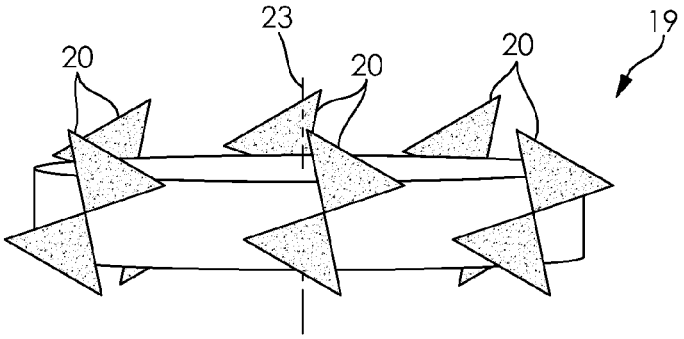

Embodiments disclosed herein also provide for a planar antenna array 18 shown in FIG. 3A, or a circular antenna array 19 shown in FIG. 3B using antenna elements 20 that are cross-polarized. Cross-polarization refers to the antenna elements 18 not being disposed in a straight-up configuration, as shown in FIG. 1, but instead being disposed at a 45° or −45° tilt from a vertical straight line or axis of symmetry 22, 23. FIGS. 3A and 3B illustrate this 45° tilt concept. Although a 45° tilt is shown, alternative angles may be used to define the degree of tilt including, but not limited to, 15°, 30°, 60°, and 75° while remaining within the intended scope of the embodiments disclosed herein.

Figure 4A:
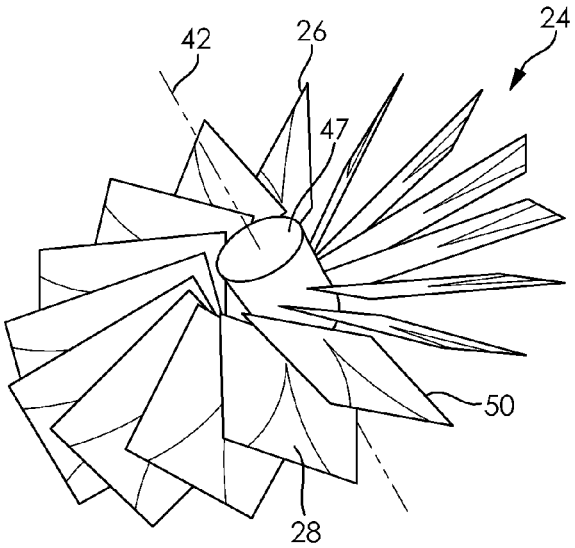
FIGS. 4A-C show isometric, side, and top views, respectively, of cross-polarized antenna elements at a 45 degree tilt in a circular antenna array.
Figure 4C:
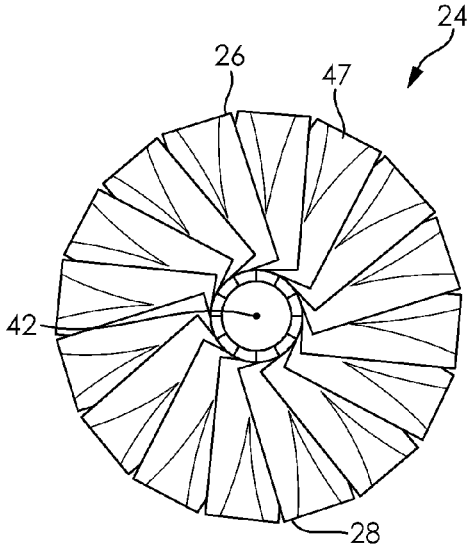
Figure 4B:
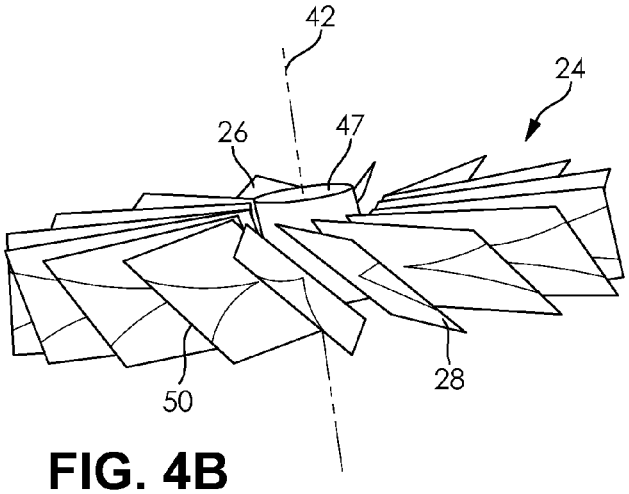

FIGS. 4A-C show isometric, side, and top views, respectively, of a flare 24 of antenna elements configured as a circular antenna array. In this flare 24, opposing front and rear antenna elements 26, 28 are disposed at a 90° difference in orientation, thereby making the antenna elements 26, 28 orthogonal with respect to each other, as shown in FIGS. 4A-C. An axis of symmetry 42 is shown in FIGS. 4A-C, which extends through a common area 47. The tilt concept is also illustrated by at least one of the plurality of antenna elements including a planar area, which has an edge 50 that is disposed non-parallel to the axis of symmetry 42 when viewed normal to the axis of symmetry 42.

When either the front antenna element 26 or the rear antenna element 28 is propagating, neither of the elements 26, 28 sees the opposing element since the elements 26, 28 are perpendicular to each other. That is, there is no coupling or reflection between the front and rear opposing elements 26, 28. Stated differently, an antenna element cannot see the antenna element on the other side of the circular antenna array, and thus there is no interaction between opposing antenna elements.

Figure 5:
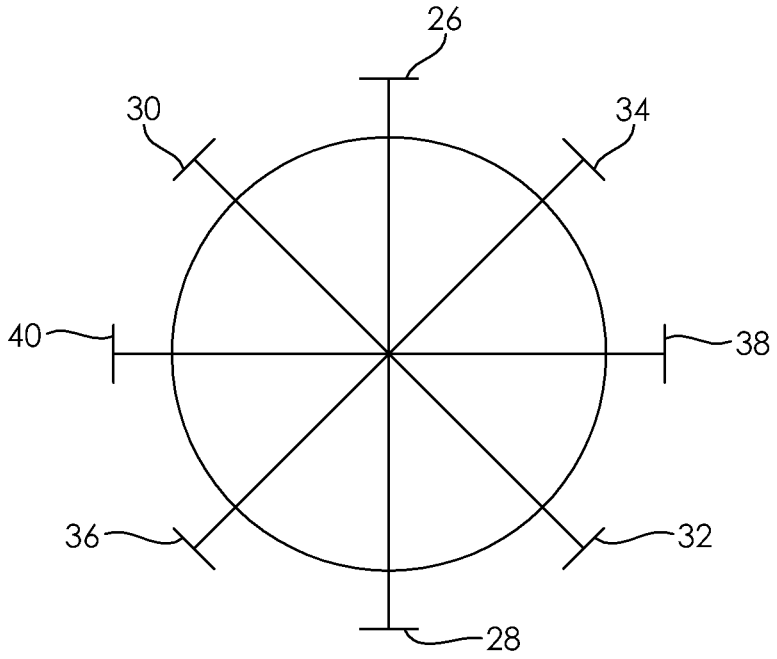
FIG. 5 shows a top view of a circular antenna array, in which opposing elements have been identified.

FIG. 5 identifies pairs of opposing antenna elements (26, 28), (30, 32), (34, 36), and (38, 40). By configuring these antenna elements at a 45 degree tilt in a circle, an inward antenna element propagates through the corresponding opposing antenna element disposed on the opposing side of the circle. As indicated above, log periodic antennas are fed in the opposite direction because the antenna elements radiate in the opposite direction. That is, the antenna elements will radiate inward towards the center of the circle. However, if the antenna elements are flared at a 45 degree angle, the opposing antenna element disposed on the opposite side of the circle, will be flared at a −45 degree angle, and since the antenna elements are 90 degrees apart, the opposing antenna elements will be orthogonal to each other, and thus opposing antenna elements will not block their respective radiations.

Broadband antenna elements, such as, but not limited to, log-periodic and Vivaldi antenna elements can be used in the embodiments disclosed herein.

Although the specification describes components and functions implemented in the embodiments with reference to particular standards and protocols, the embodiment are not limited to such standards and protocols.

The illustrations of embodiments described herein are intended to provide a general understanding of the structure of various embodiments, and are not intended to serve as a complete description of all the elements and features of apparatuses and systems that may make use of the structures described herein. Many other embodiments will be apparent to those of skill in the art upon reviewing the above description. Other embodiments are utilized and derived therefrom, such that structural and logical substitutions and changes are made without departing from the scope of this disclosure. Figures are also merely representational and are not drawn to scale. Certain proportions thereof are exaggerated, while others are decreased. Accordingly, the specification and drawings are to be regarded in an illustrative rather than a restrictive sense.

Such embodiments of the inventive subject matter are referred to herein, individually and/or collectively, by the term "embodiment" merely for convenience and without intending to limit the scope of this application to any single embodiment or inventive concept. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single embodiment. Thus, the following claims are hereby incorporated into the detailed description, with each claim standing on its own as a separate example embodiment.

The abstract is provided to comply with 37 C.F.R. §1.72 (b), which requires an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single embodiment. Thus the following claims are hereby incorporated into the Detailed Description, with each claim standing on its own as separately claimed subject matter.

Although specific example embodiments have been described, it will be evident that various modifications and changes are made to these embodiments without departing from the broader scope of the inventive subject matter described herein. Accordingly, the specification and drawings are to be regarded in an illustrative rather than a restrictive sense. The accompanying drawings that form a part hereof, show by way of illustration, and without limitation, specific embodiments in which the subject matter are practiced. The embodiments illustrated are described in sufficient detail to enable those skilled in the art to practice the teachings herein. Other embodiments are utilized and derived therefrom, such that structural and logical substitutions and changes are made without departing from the scope of this disclosure. This Detailed Description, therefore, is not to be taken in a limiting sense, and the scope of various embodiments is defined only by the appended claims, along with the full range of equivalents to which such claims are entitled.

Given the teachings of the embodiments disclosed herein, one of ordinary skill in the art will be able to contemplate other implementations and applications of the techniques disclosed herein. Although illustrative embodiments have been described herein with reference to the accompanying drawings, it is to be understood that these embodiments are not limited to those precise embodiments disclosed, and that various other changes and modifications are made therein by one skilled in the art without departing from the scope of the appended claims.

What is claimed is:

1. An antenna array, which comprises:

a plurality of antenna elements, the plurality of antenna elements being configured in a flare such that each of the plurality of antenna elements is uniformly spaced apart from at least one adjacent antenna element based on wavelengths associated with an operating frequency band, thereby providing a constant beamwidth over the operating frequency band, each of the plurality of antenna elements being coupled in a common area, each of the plurality of antenna elements extending radially outward from the common area; and an axis of symmetry extending through the common area, at least one of the plurality of antenna elements comprising a planar area, the planar area comprising an edge, the edge being disposed non-parallel to the axis of symmetry when viewed in a direction that is normal to the axis of symmetry and coplanar with the planar area.

2. The antenna array, as defined by claim 1, wherein the plurality of antenna elements is configured in at least one of a half circle and sphere.

3. The antenna array, as defined by claim 1, wherein the at least one of the plurality of antenna elements comprises at least one of a bow tie antenna and Vivaldi antenna.

4. The antenna array, as defined by claim 1, wherein at least one of the plurality of antenna elements is disposed at a tilt with respect to the axis of symmetry when viewed in a direction that is normal to the axis of symmetry and coplanar with the planar area.

5. The antenna array, as defined by claim 1, further comprising a feed, the feed being disposed in the common area, the feed being operatively coupled to at least one of the plurality of antenna elements.

6. A method of arranging a plurality of antenna elements in an antenna array; which comprises:

configuring the plurality of antenna elements in a flare such that each antenna element is uniformly spaced apart from at least one adjacent antenna element based on wavelengths associated with an operating frequency band, thereby providing a constant beamwidth over the operating frequency band, each of the plurality of antenna elements extending radially outward from a common area; and coupling each of the plurality of antenna elements in the common area, the antenna array comprising an axis of symmetry extending through the common area, at least one of the plurality of antenna elements comprising a planar area, the planar area comprising an edge; and disposing the edge non-parallel to the axis of symmetry when viewed in a direction that is normal to the axis of symmetry and coplanar with the planar area.

7. The method, as defined by claim 6, further comprising configuring the plurality of antenna elements in at least one of a half circle and sphere.

8. The method, as defined by claim 6, wherein the at least one of the plurality of antenna elements comprises at least one of a bow tie antenna and Vivaldi antenna.

9. The method, as defined by claim 6, further comprising disposing at least one of the plurality of antenna elements at a tilt with respect to the axis of symmetry when viewed in a direction that is normal to the axis of symmetry and coplanar with the planar area.

10. The method, as defined by claim 6, wherein the antenna array further comprises a feed, the method further comprising:

disposing the feed in the common area; and coupling the feed being operatively to at least one of the plurality of antenna elements.

* * * * *